US011715879B1

(12) United States Patent
Li et al.

(10) Patent No.: US 11,715,879 B1
(45) Date of Patent: Aug. 1, 2023

(54) MULTI-LAYER LOW-PROFILE FOUR-ARM SPIRAL ANTENNA

(71) Applicant: Anhui University, Hefei (CN)

(72) Inventors: Yingsong Li, Hefei (CN); Zhixiang Huang, Hefei (CN); Jiahong Wang, Harbin (CN)

(73) Assignee: Anhui University, Hefei (CN)

( * ) Notice: Subject to any disclaimer, the term of this patent is extended or adjusted under 35 U.S.C. 154(b) by 0 days.

(21) Appl. No.: 18/186,815

(22) Filed: Mar. 20, 2023

(30) Foreign Application Priority Data

Jun. 20, 2022 (CN) ..... 202210696229.8

(51) Int. Cl.
*H01Q 11/08* (2006.01)
*H01Q 1/42* (2006.01)
*H01Q 9/27* (2006.01)

(52) U.S. Cl.
CPC ..... *H01Q 11/08* (2013.01); *H01Q 1/422* (2013.01); *H01Q 9/27* (2013.01)

(58) Field of Classification Search
CPC ..... H01Q 1/422; H01Q 9/27; H01Q 11/08
See application file for complete search history.

(56) References Cited

U.S. PATENT DOCUMENTS 5,255,005 A 10/1993 Terret et al.

FOREIGN PATENT DOCUMENTS

| | | | |
|---|---|---|---|
| CN | 101316005 | A | 12/2008 |
| CN | 104882667 | A | 9/2015 |
| CN | 105811099 | A | 7/2016 |
| CN | 106329141 | A | 1/2017 |
| CN | 107104280 | A | 8/2017 |
| CN | 110199434 | A | 9/2019 |
| CN | 209401825 | U | 9/2019 |
| CN | 112271435 | A | 1/2021 |

OTHER PUBLICATIONS

First Office Action issued in counterpart Chinese Patent Application No. 202210696229.8, dated Oct. 20, 2022.
Hyzazie et al., Multi/Wide Band Printed Quad Helical Antenna, 2020 IEEE International Symposium on Antennas and Propagation and North American Radio Science Meeting, Montreal, QC, Canada, pp. 1893-1894, DOI: 10.1109/IEEECONF35879.2020.9329448, dated Jul. 10, 2020.

*Primary Examiner* — Robert Karacsony
(74) *Attorney, Agent, or Firm* — Westbridge IP LLC

(57) ABSTRACT

Disclosed is a multi-layer low-profile four-arm spiral antenna, including a metal grounding plate, and a top surface of the metal grounding plate is fixedly connected with three layers of cylindrical dielectric substrates; the three layers of dielectric substrates are coaxially arranged, and the three layers of dielectric substrates are coaxially arranged with the metal grounding plate, and a gap is set between two adjacent layers of dielectric substrates; four spiral metal strips with a same rotation direction are respectively arranged on each layer of dielectric substrate, the four spiral metal strips on each layer of dielectric substrate form spiral radial arms, and a phase difference of the four spiral metal strips on each layer of dielectric substrate is 90°; the corresponding spiral metal strips on the two adjacent layers of dielectric substrates are connected by connecting bridges, the connecting bridges are arranged in the gap.

6 Claims, 3 Drawing Sheets

MULTI-LAYER LOW-PROFILE FOUR-ARM SPIRAL ANTENNA

CROSS-REFERENCE TO RELATED APPLICATIONS

This application claims priority to Chinese Patent Application No. 202210696229.8, filed on Jun. 20, 2022, the contents of which are hereby incorporated by reference.

TECHNICAL FIELD

The application relates to the technical field of wireless communication, and in particular to a multi-layer low-profile four-arm spiral antenna.

BACKGROUND

Circularly polarized antennas have received an extensive attention in recent years with a rapid development of wireless communication technology. Many circularly polarized antennas have been developed in worldwide and applied to various wireless communication systems, such as a global positioning system (GPS) and satellite communication. The circularly polarized antennas have been widely used in radio frequency identification, the GPS, the satellite communication and radio frequency energy harvesting systems, etc., since the circularly polarized antennas may help prevent multipath distortion and polarization mismatch losses caused by a Faraday rotation effect when sending and receiving signals. The circularly polarized antennas may reduce polarization mismatches, eliminate Faraday rotations when the signals pass through ionospheres, and provide a great flexibility in directions of transmitters and receivers. In order to realize circularly polarized radiations, common receiving antennas of satellite navigation systems are mainly microstrip antennas and four-arm spiral antennas. The four-arm spiral antennas are widely used because of cardioid radiation patterns, wide angle radiations and good beam widths. In addition, symmetrical structures of the four-arm spiral antennas maintain stable phase centers. In recent years, a printed four-arm spiral antenna has attracted a wide attention because of advantages of a light weight, a low cost, a good axial ratio and an easy manufacture, and has a broader application prospect. Compared with microstrip patch antennas, the four-arm spiral antennas are larger in size and higher in profile, so miniaturization is one of important topics in a design of the four-arm spiral antennas.

At present, a development trend of the antennas is high efficiency, miniaturization and light weight, while conventional four-arm spiral antennas have disadvantages of large volumes and high profiles. In addition, with gradual miniaturization of communication equipment, requirements for the antennas are more demanding. On a premise that performances of the antennas are not disturbed, antenna miniaturization is one of main problems that antenna researchers need to solve urgently. The four-arm spiral antennas may better meet needs of the satellite navigation systems through the miniaturization and a low-profile design. Therefore, the miniaturization and the low profile may be the problems to be solved in the design and a practical engineering application of the four-arm spiral antennas, and are also development trends of the four-arm spiral antennas at present.

SUMMARY

An objective of the application is to provide a multi-layer low-profile four-arm spiral antenna to solve problems existing in the prior art.

In order to achieve the above objective, the application provides a following scheme. The application provides the multi-layer low-profile four-arm spiral antenna, including a metal grounding plate, and a top surface of the metal grounding plate is fixedly connected with three layers of cylindrical dielectric substrates; the three layers of dielectric substrates are coaxially arranged, and the three layers of dielectric substrates are coaxially arranged with the metal grounding plate, and a gap is set between two adjacent layers of dielectric substrates; four spiral metal strips with a same rotation direction are respectively arranged on each layer of dielectric substrate, the four spiral metal strips on each layer of dielectric substrate form spiral radial arms, and a phase difference of the four spiral metal strips on each layer of dielectric substrate is 90°; the corresponding spiral metal strips on the two adjacent layers of dielectric substrates are connected by connecting bridges, the connecting bridges are arranged in the gap, and axes of the connecting bridges are perpendicular to axes of the dielectric substrates.

In an embodiment, the connecting bridges are metal bridges, and the metal bridges are divided into two groups, each group includes four, and axes of the metal bridges are perpendicular to the axes of the dielectric substrates.

In an embodiment, a top end of an outer wall of the dielectric substrate located in an outermost layer is fixedly sheathed with an annular metal strip, and top ends of the spiral metal strips of the dielectric substrate located in the outermost layer are fixedly connected with the annular metal strip, and the annular metal strip is integrally formed with the spiral metal strips; and bottom end ports of the spiral metal strips of the dielectric substrate located in the outermost layer are coaxially fed, and a phase difference of four feeding ports is 90°.

In an embodiment, bottom ends of the spiral metal strips on the dielectric substrate located in an intermediate layer are fixedly connected with a top end of the metal grounding plate; tops of the spiral metal strips on the dielectric substrate located in the intermediate layer are open.

In an embodiment, both ends of each spiral metal strip located on an outer wall of the dielectric substrate located in an innermost layer are open.

In an embodiment, the spiral metal strips on the dielectric substrates are arranged on outer walls of the dielectric substrates via printing.

The application discloses following technical effects: the multi-layer low-profile four-arm spiral antenna provided by the application adopts a multi-layer structure; the four spiral metal strips of four-arm spiral structures of the two adjacent layers are connected by the connecting bridges respectively, so that the four-arm spiral structures of the four-arm spiral antenna are divided into three layers; lengths of the radial arms of the four-arm spiral antenna are increased through the multi-layer structure to correspond to a quarter wavelength of a radiation frequency, and a profile height of the four-arm spiral antenna is effectively reduced by the multi-layer structure. The multi-layer low-profile four-arm spiral antenna designed by the application has a low profile, a miniaturized structure, a good axial ratio, a large beam width and a cardioid pattern, may be well applied to satellite communication systems, and has a practical application value.

BRIEF DESCRIPTION OF THE DRAWINGS

In order to more clearly explain embodiments of the application or technical schemes in the prior art, drawings needed in the embodiments may be briefly introduced below.

Obviously, the drawings in the following description are only one embodiment of the application, and other drawings may be obtained according to these drawings without creative work for ordinary people in the field.

DETAILED DESCRIPTION OF THE EMBODIMENTS

Technical schemes in embodiments of the application may be described clearly and completely with reference to attached drawings. Obviously, the described embodiments are only a part of the embodiments of the application, but not all embodiments. Based on the embodiments in the application, all other embodiments obtained by ordinary technicians in the field without a creative labor belong to a protection scope of the application.

In order to make above objects, features and advantages of the application more obvious and easier to understand, the application may be further described in detail with reference to the attached drawings and specific embodiments.

Figure 1:
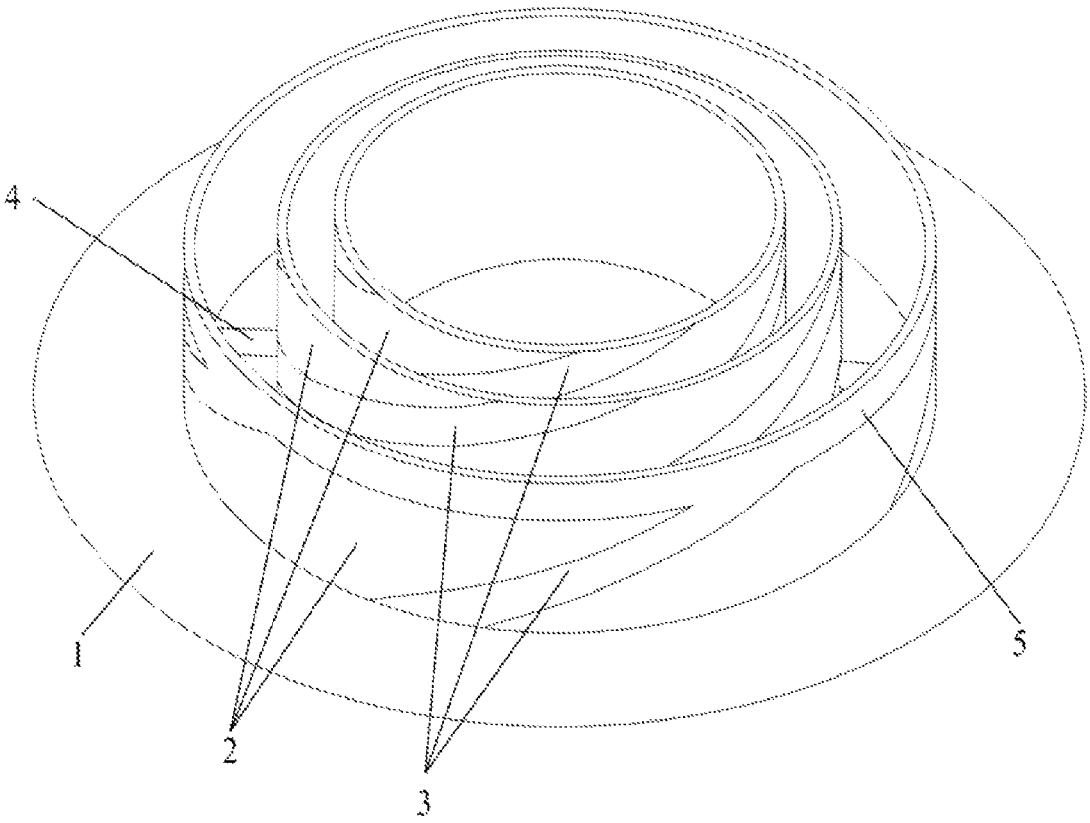
FIG. 1 is a three-dimensional structural diagram of the application.
Figure 2:
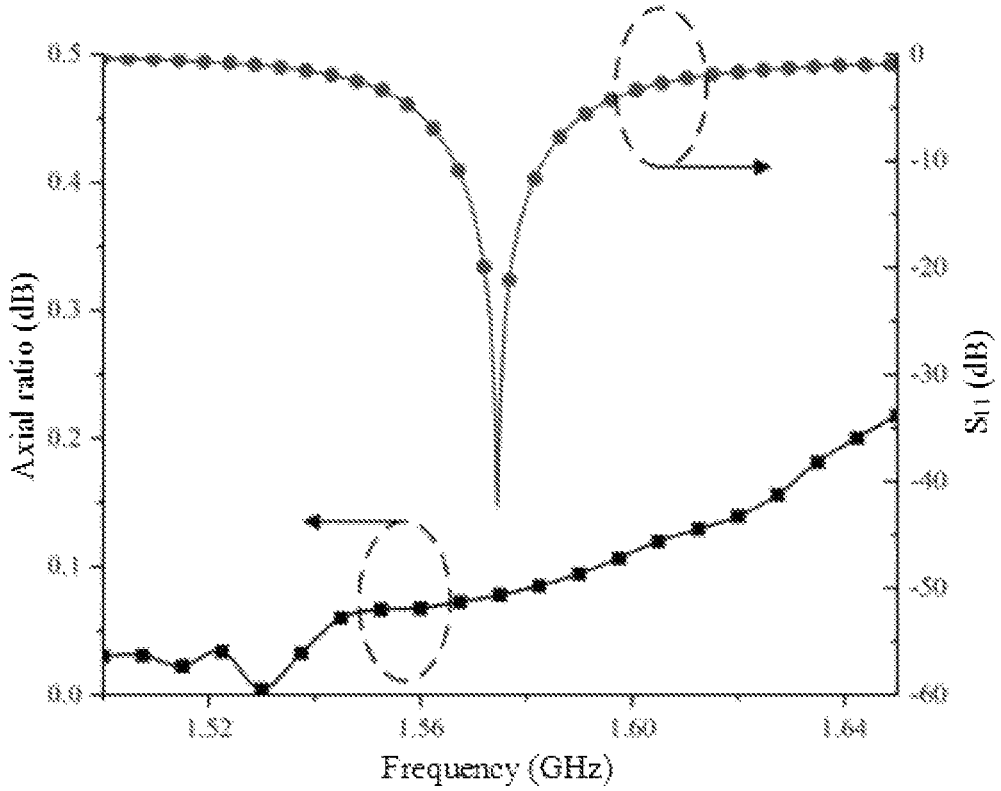
FIG. 2 shows S11 and an axial ratio of a multi-layer low-profile four-arm spiral antenna according to the application.
Figure 3:
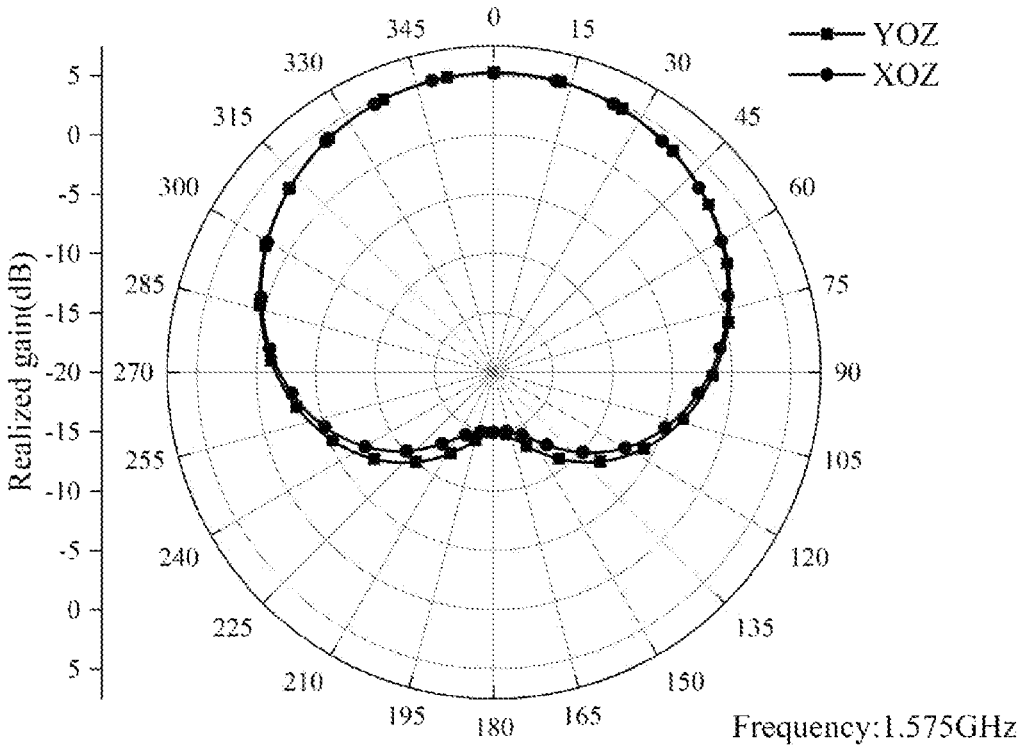
FIG. 3 is a pattern of a multi-layer low-profile four-arm spiral antenna at 1.575 GHz.

With reference to FIGS. 1-3, the application provides a multi-layer low-profile four-arm spiral antenna, including a metal grounding plate 1, and a top surface of the metal grounding plate 1 is fixedly connected with three layers of cylindrical dielectric substrates 2; the three layers of dielectric substrates 2 are coaxially arranged, and the three layers of dielectric substrates 2 are coaxially arranged with the metal grounding plate 1, and a gap is set between two adjacent layers of dielectric substrates 2; four spiral metal strips 3 with a same rotation direction are respectively arranged on each layer of dielectric substrate 2, the four spiral metal strips 3 on each layer of dielectric substrate 2 form spiral radial arms, and a phase difference of the four spiral metal strips 3 on each layer of dielectric substrate 2 is 90°; the corresponding spiral metal strips 3 on the two adjacent layers of dielectric substrates 2 are connected by connecting bridges, the connecting bridges are arranged in the gap, and axes of the connecting bridges are perpendicular to axes of the dielectric substrates 2.

The four spiral metal strips 3 of four-arm spiral structures of the two adjacent layers are connected by the connecting bridges respectively, so that the four-arm spiral structures of the four-arm spiral antenna are divided into three layers; lengths of the radial arms of the four-arm spiral antenna are increased through a multi-layer structure to correspond to a quarter wavelength of a radiation frequency, and a profile height of the four-arm spiral antenna is effectively reduced by the multi-layer structure. The multi-layer low-profile four-arm spiral antenna designed by the application has a low profile, a miniaturized structure, a good axial ratio, a large beam width and a cardioid pattern, may be well applied to satellite communication systems, and has a practical application value. The multi-layer low-profile four-arm spiral antenna provided by the application adopts the multi-layer structure to realize the low profile and ensure radiation characteristics of the four-arm spiral antenna that a half-power beam width of the cardioid pattern remains greater than 120°. The multi-layer low-profile four-arm spiral antenna provided by the application has the profile height of only 10 mm when a global positioning system L1 (GPSL1) band works, and has the excellent cardioid pattern and excellent circular polarization characteristics, so that a monitoring range and a monitoring accuracy of satellite navigation are ensured, and requirements of antenna miniaturization are met.

In an embodiment, the connecting bridges are metal bridges 4; the metal bridges 4 are divided into two groups, each group includes four, and axes of the metal bridges 4 are perpendicular to the axes of the dielectric substrates 2.

The two adjacent four-arm spiral structures are connected by the metal bridges 4 to increase a relative arm length of the four-arm spiral antenna. There are eight metal bridges 4 in the whole four-arm spiral antenna. A correlation between the relative arm length and the wavelength is realized by adjusting positions of the metal bridges 4 and changing the relative arm length of the antenna, so that a central frequency of the antenna is 1.57 GHz, working frequencies of Beidou-3 and a global positioning system (GPS) are met, and a low profile design of the antenna is realized. In this frequency band, the profile height of the antenna is only 10 mm.

In an embodiment, a top end of an outer wall of the dielectric substrate 2 located in an outermost layer is fixedly sheathed with an annular metal strip 5, and top ends of the spiral metal strips 3 of the dielectric substrate 2 located in the outermost layer are fixedly connected with the annular metal strip 5, and the annular metal strip 5 is integrally formed with the spiral metal strips 3; and bottom end ports of the spiral metal strips 3 of the dielectric substrate 2 located in the outermost layer are coaxially fed, and a phase difference of four feeding ports is 90°.

With a coaxial feed mode with a phase difference of 90°, a feed network may be added under the metal grounding plate 1 to realize a feed with the phase difference of 90°. The coaxial feed mode has a large power capacity, an easy selection and control of feed impedance, and a small design size. The antenna matches well by adjusting a size of the coaxial feed network, and the feed with the phase difference of 90° ensures the circular polarization characteristics of the antenna in a working bandwidth and meets the requirements of the satellite communication systems. The application has the axial ratio of less than 0.5 dB and has the excellent circular polarization characteristics in the working bandwidth.

In an embodiment, bottom ends of the spiral metal strips 3 on the dielectric substrate 2 located in an intermediate layer are fixedly connected with the top end of the metal grounding plate 1; tops of the spiral metal strips 3 on the dielectric substrate 2 located in the intermediate layer are open.

In an embodiment, both ends of each spiral metal strip 3 located on an outer wall of the dielectric substrate 2 located in an innermost layer are open. In an embodiment, materials of the dielectric substrates 2 are FR-4 materials.

In an embodiment, the spiral metal strips 3 on the dielectric substrates 2 are arranged on the outer walls of the dielectric substrates 2 via printing. The annular metal strip 5 is also arranged on the outer wall of one dielectric substrate 2 via printing.

The spiral metal strips 3 are printed on the three layers of cylindrical dielectric substrates 2, so that a processing cost is greatly reduced. The four spiral metal strips 3 printed on each layer of cylindrical dielectric substrate 2 have the phase difference of 90°, and all the spiral metal strips 3 have the same rotation direction. Included angles between the spiral metal strips 3 of each layer and the metal ground plane are different, and the included angles with the metal ground plane decrease from the outermost layer to the innermost layer. According to a design method of the four-arm spiral antenna, the four spiral metal strips 3 printed on the dielectric substrate 2 in the outermost layer constitute a first four-arm spiral structure, the four spiral metal strips 3 printed on the dielectric substrate 2 in the intermediate layer constitute a second four-arm spiral structure, and the four spiral metal strips 3 printed on the cylindrical dielectric substrate 2 in the innermost layer constitute a third four-arm spiral structure.

In an embodiment, the metal grounding plate 1 is made of copper, aluminium or other metal materials. Materials of the metal grounding plate 1 include, but are not limited to, copper and aluminium.

The metal grounding plate 1 has a function of preventing other useless electromagnetic waves in the gap from being transmitted to a radiation unit while reflecting the electromagnetic waves as a reflector, thus realizing a directional radiation of the antenna. Moreover, the metal grounding plate 1 may improve a gain of the antenna, so that the four-arm spiral antenna has stable radiation characteristics.

The application discloses the multi-layer low-profile four-arm spiral antenna, and the antenna realizes the low profile by adopting the multi-layer structure. The cardioid radiation pattern, wide beams and the excellent radiation characteristics of the four-arm spiral antenna are ensured under a condition of reducing the profile height. The relative arm length of the four-arm spiral antenna is changed by adding the metal bridges 4 between the four-arm spiral structures of the two adjacent layers and changing the positions of the metal bridges 4, and the arm length of the four-arm spiral antenna is consistent with a quarter wavelength of the working frequency. This method realizes the low-profile design of the four-arm spiral antenna. The multi-layer low-profile four-arm spiral antenna designed by the application has the advantages of a simple structure, easy processing, simple debugging steps, the cardioid pattern, wide beamwidth, good circular polarization characteristics and the like, so the antenna may be widely used in satellite navigation systems.

In the description of the application, it is necessary to understand that an orientation or position relationship indicated by terms "longitudinal", "horizontal", "up", "down", "front", "back", "left", "right", "vertical", "horizontal", "top", "bottom", "inside", "outside", etc. is based on the orientation or position relationship shown in the attached drawings, only for a convenience of describing the application, rather than indicating or implying that the device or element referred to must have a specific orientation, be constructed and operated in a specific orientation. Therefore, the terms may not be understood as a limitation of the application.

The above-mentioned embodiments only describe preferred modes of the application, and do not limit the scope of the application. Under a premise of not departing from a design spirit of the application, various modifications and improvements made by ordinary technicians in the field to the technical schemes of the application may fall within the protection scope determined by claims of the application.

What is claimed is:

1. A multi-layer low-profile four-arm spiral antenna, comprising a metal grounding plate, wherein a top surface of the metal grounding plate is fixedly connected with three layers of cylindrical dielectric substrates; the three layers of dielectric substrates are coaxially arranged, and the three layers of dielectric substrates are coaxially arranged with the metal grounding plate, and a gap is set between two adjacent layers of the dielectric substrates; four spiral metal strips with a same rotation direction are respectively arranged on each layer of the dielectric substrate, the four spiral metal strips on each layer of the dielectric substrate form spiral radial arms, and a phase difference of the four spiral metal strips on each layer of the dielectric substrate is 90°; and the corresponding spiral metal strips on the two adjacent layers of the dielectric substrates are connected by connecting bridges, the connecting bridges are arranged in the gap, and axes of the connecting bridges are perpendicular to axes of the dielectric substrates, and the connecting bridges are metal bridges.

2. The multi-layer low-profile four-arm spiral antenna according to claim 1, wherein the metal bridges are divided into two groups, each group comprises four, and the axes of the metal bridges are perpendicular to the axes of the dielectric substrates.

3. The multi-layer low-profile four-arm spiral antenna according to claim 1, wherein a top end of an outer wall of the dielectric substrate located in an outermost layer is fixedly sheathed with an annular metal strip, and top ends of the spiral metal strips of the dielectric substrate located in the outermost layer are fixedly connected with the annular metal strip, and the annular metal strip is integrally formed with the spiral metal strips; and bottom end ports of the spiral metal strips of the dielectric substrate located in the outermost layer are coaxially fed, and a phase difference of four feeding ports is 90°.

4. The multi-layer low-profile four-arm spiral antenna according to claim 1, wherein bottom ends of the spiral metal strips on the dielectric substrate located in an intermediate layer are fixedly connected with a top end of the metal grounding plate; and tops of the spiral metal strips on the dielectric substrate located in the intermediate layer are open.

5. The multi-layer low-profile four-arm spiral antenna according to claim 4, wherein both ends of each spiral metal strip located on an outer wall of the dielectric substrate located in an innermost layer are open.

6. The multi-layer low-profile four-arm spiral antenna according to claim 1, wherein the spiral metal strips on the dielectric substrates are arranged on outer walls of the dielectric substrates via printing.

* * * * *